US007513016B2

(12) United States Patent
Hergeth

(10) Patent No.: US 7,513,016 B2
(45) Date of Patent: Apr. 7, 2009

(54) INCLINED MILLING MACHINE

(75) Inventor: Hubert Hergeth, Zug (CH)

(73) Assignee: Hubert Hergeth, Zug (CH)

( * ) Notice: Subject to any disclaimer, the term of this patent is extended or adjusted under 35 U.S.C. 154(b) by 0 days.

(21) Appl. No.: 11/608,696

(22) Filed: Dec. 8, 2006

(65) Prior Publication Data

US 2007/0174999 A1 Aug. 2, 2007

(30) Foreign Application Priority Data

Dec. 10, 2005 (DE) ..... 10 2005 059 151

(51) Int. Cl.
*D01G 7/06* (2006.01)

(52) U.S. Cl. ..... 19/80 R

(58) Field of Classification Search ..... 19/80 R, 19/81, 97.5, 145.5
See application file for complete search history.

(56) References Cited

U.S. PATENT DOCUMENTS

| | | | | |
|---|---|---|---|---|
| 4,377,021 | A * | 3/1983 | Peters | 19/80 R |
| 4,813,103 | A | 3/1989 | Walk et al. | 19/80 |
| 4,888,857 | A | 12/1989 | Pinto et al. | 19/80 |
| 4,995,142 | A | 2/1991 | Binder et al. | 19/80 |
| 5,044,045 | A | 9/1991 | Demuth et al. | 19/80 |
| 5,179,763 | A | 1/1993 | Zander et al. | 19/80 |
| 5,237,725 | A * | 8/1993 | Temburg | 19/80 R |
| 5,276,946 | A * | 1/1994 | Pinto et al. | 19/97.5 |
| 5,315,738 | A * | 5/1994 | Pinto et al. | 19/145.5 |
| 5,515,577 | A * | 5/1996 | Pinto et al. | 19/80 R |
| 5,768,750 | A * | 6/1998 | Williams | 19/80 R |

FOREIGN PATENT DOCUMENTS

| | | |
|---|---|---|
| DE | 29 31 500 | 2/1981 |
| DE | 36 37 580 | 3/1988 |
| DE | 37 30 487 | 3/1989 |
| DE | 39 33 274 | 4/1991 |
| DE | 40 40 197 | 6/1992 |
| DE | 41 31 424 | 1/1993 |
| DE | 43 03 685 | 8/1994 |
| EP | 327 885 | 8/1989 |
| EP | 386 580 | 2/1990 |

* cited by examiner

*Primary Examiner*—Shaun R Hurley
(74) *Attorney, Agent, or Firm*—Proskauer Rose LLP

(57) ABSTRACT

A milling machine for working off several textile bales in a wedge shape includes a pendulum or a sliding bed for moving the bales forward in the cutting zone, wherein the bales are worked off in a wedge shape under at least two different angles. That is, the angle between the direction of the back and forth work off movement and the direction of the forward movement at the lowest work off zone is less than in the centre of the inclined work off path.

5 Claims, 2 Drawing Sheets

INCLINED MILLING MACHINE

CROSS REFERENCE TO RELATED APPLICATIONS

This application claims priority to German patent application no. DE 10 2005 059 151.5 filed on Dec. 10, 2005. The disclosure of the above applications is incorporated herein by reference in its entirety.

BACKGROUND

Milling machines, which work off the bales from the top, have been used in the textile industry since the end of the 1970s. Although milling machines, which work off the bales substantially horizontally, by far represent the most common form, there are, however, attempts to work off the bales in a wedge-shape. This has the following advantages: as the bales are also mixed through different levels of the bales, there is less fluctuation in the moisture content. A new line-up of bales is not brought to the mixture at once, but only one or two bales at anyone time. This reduces fluctuations in the card sliver uniformity. Lining up the bales, in so far as they only need to be leant against the previous bale, is very much easier. Machines made by Hergeth DE 2931 500,3637580,3730487, 3933274 and 41 31 424 and also later made by Trützschler DE 40 40 197 and 43 03 685 have been marketed. Rieter has also put forward suggestions: EP 386 580 and EP 327 885. All have had little success in the market due to their high price and complexity. A special problem of inclined milling machines is adding on new bales if the operatives did not have time to line up new bales in direct succession as called for by the machine. In order to render the possibility of joining up the bales, the two conveyor belts for the bales were partitioned several times and provided with fast advance and return. If a gap developed, bales were fetched back by bringing sections backwards and new bales were rapidly lined up and through fast advance an attempt was made to join them up with the bales being worked off. This was very laborious and often led to unstable bales falling over during fast advance and return. Another solution to the joining problem was proposed by the Trützschler Company using a loading carriage. Here, a carriage with a small conveyor belt and a "bale standing aid" for the bales moves back and forth between the loading point and the extremity of the bales being worked off. The loading carriage is guided on rails parallel to the conveyor and moves the bales over the conveyor. The carriage is loaded outside the bed conveyor belt and transports the bales away over the bed conveyor belt as far as the bales being worked off. The new bale is lined up there by the loading carriage.

A second problem with these conveyor belt/inclined milling machines is the working off of the last remainder at the tip of the wedge formed by the bales. If the conveyor goes beyond the path of the cutter head, due to the grated hoop and the covers, the first cutter roller can not get close to the conveyor belt. Often residues remain which have to be removed by hand or which prevent the cutter carriages from reaching the point of return. If the conveyor belt is shorter than the path of the cutter head, the suction stream collapses on exceeding the cutter head of the conveyor belt extremity, since too much grated surface lies exposed. The fibres are then not sucked along by the air current and fall behind the conveyor belt onto the bed. With a pendulum rising bed, no cut-off line of the transport medium is present due to the pendulum movement and therefore inclined running beyond an exact extremity, as in the case of the conveyor belt, is not possible.

SUMMARY OF THE INVENTION

The object of the invention is to create a very economic bale milling machine for inclined working off, which overcomes the problems described above and which works off the bales cleanly at the end of the incline. This is achieved according to the invention by using a pendulum rising or sliding bed in conjunction with a cutter head, which every time it passes beyond the extremity of the wedge being cut assumes a flat angle to the bale transport track. FIG. 1 shows an exemplary embodiment of such a bale milling machine.

DESCRIPTION

Figure 1:
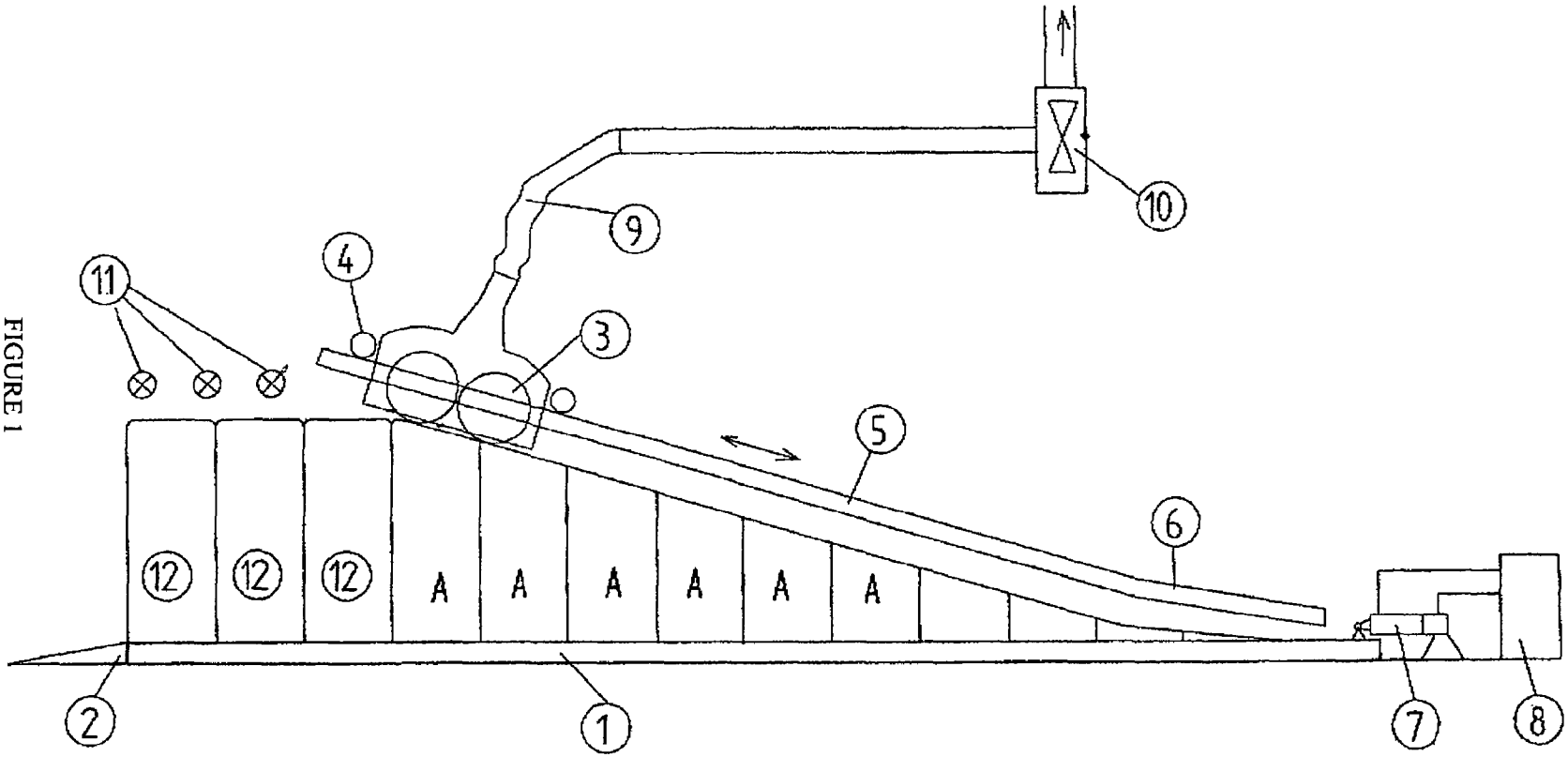
FIG. 1 is a side view of an embodiment of an inclined bale milling machine.
Figure 2:
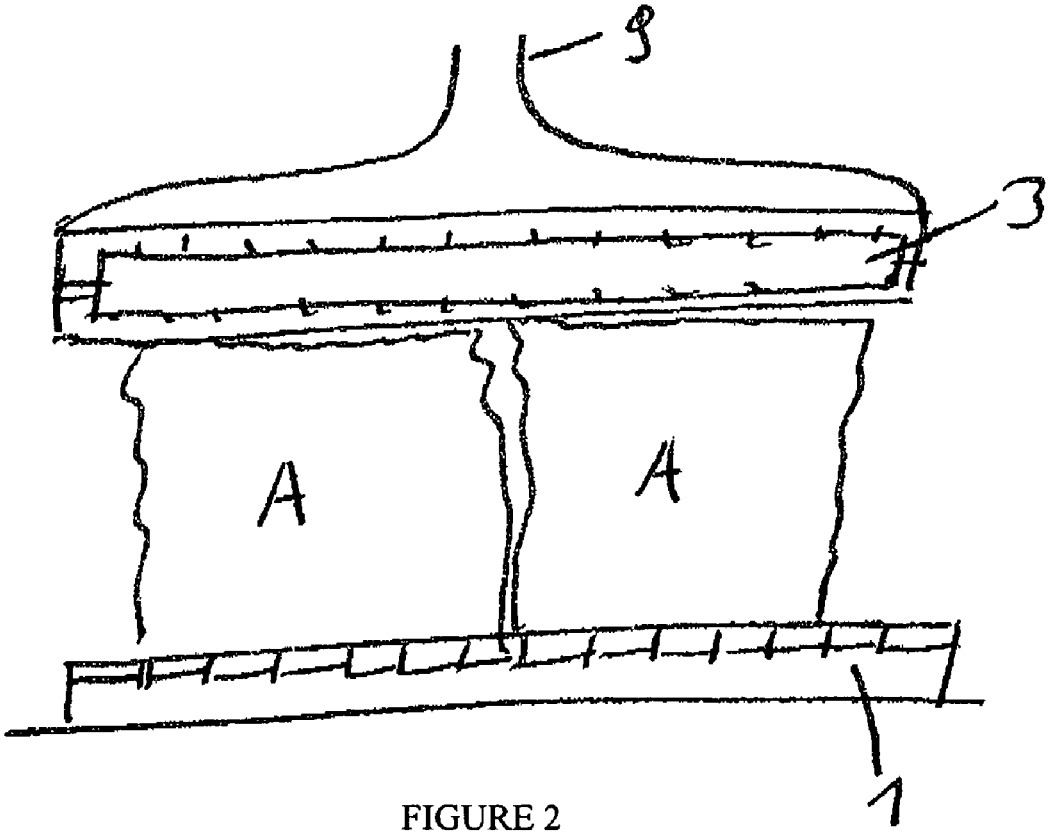
FIG. 2 is a sectional view of an embodiment of the inclined bale milling machine of FIG. 1.

A pendulum bed (1) is installed on the factory floor and can be operated by means of a ramp (2) with a fork-lift truck. Reserve bales (12) can be lined up whilst bales A are being worked off. The cutter head (3) with the cutter rollers moves over rollers (4) guided and quickly driven back and forth on a track (5) and (6).

The bales are slowly moved by the pendulum bed forwards towards the wedge tip. The forward velocity of travel determines the production output. The track rises more steeply in zone (5), in order to be able to work off large bales with a short pendulum bed. Long pendulum rising beds are expensive. At the tip of the bale milling zone the inclination of track (6) is flatter, approximately horizontal, so as to be able to work off the ends of the bales satisfactorily. The pendulum bed is moved by hydraulic cylinders (7), which are supplied by a hydraulic pump (8). Through a reciprocating hose (9) the cutter head is constantly under suction and the worked off fibres are blown by a fan (10) to the next processing stage. Pairs of light barriers (11) monitor the loading zone for reserve bales (12). Since a pendulum bed can easily be manufactured in large widths, but is expensive in large lengths, it is advantageous, in a way different than previously, to line up and work off two bales side by side. If a fork-lift truck is in the vicinity of the light barriers, the beam of light is interrupted and the pendulum bed stops, until the fork-lift truck has moved away again. Overloading of the sliding surfaces and hydraulics is prevented by halting the reciprocating movement. The pendulum bed and hydraulics may be of less heavy construction. By using the pendulum rising bed and the different cutting angles, inclined working off has finally become economic and simple for the processors.

The invention claimed is:

1. Milling machine for working off textile fibre bales, wherein the bales are moved forwards continuously or intermittently, and the bales are moved forwards by a pendulum or sliding bed and the angle between the direction of the back and forth work off movement and the direction of the forward movement at the lowest work off zone is less than in the centre of the inclined work off path.

2. Milling machine according to claim 1, wherein the longitudinal sides of two bale rows are worked off in parallel simultaneously.

3. Milling machine according to claim 1 or claim 2, wherein the pendulum or sliding bed is passable in the loading zone with a fork-lift truck.

4. Milling machine according to claim 1, wherein the pendulum or sliding bed automatically stops moving, if the presence of a forklift truck is detected by a sensor.

5. Milling machine according to claim 2, wherein the pendulum or sliding bed automatically stops moving, if the presence of a fork-lift truck is detected.

* * * * *